US006039459A

United States Patent [19]

Chang

[11] Patent Number: 6,039,459

[45] Date of Patent: Mar. 21, 2000

[54] LIGHTING CIRCUIT AND ANTENNA ARRANGEMENT OF A CELLULAR TELEPHONE

[75] Inventor: Daniel Chang, Pa-Te, Taiwan

[73] Assignee: Auden Technology Mfg. Co., Ltd., Taiwan

[21] Appl. No.: 09/172,247

[22] Filed: Oct. 14, 1998

[51] Int. Cl.[7] ..... F21V 33/00

[52] U.S. Cl. ..... 362/253; 362/800

[58] Field of Search ..... 362/253, 800

[56] References Cited

U.S. PATENT DOCUMENTS 2,583,066 1/1952 Stiffel ..... 343/721

5,605,506 2/1997 Hoorn et al. ..... 362/253

*Primary Examiner*—Cassandra Spyrou
*Assistant Examiner*—Euncha Cherry
*Attorney, Agent, or Firm*—Dougherty & Troxell

[57] ABSTRACT

A lighting circuit and antenna arrangement includes a receptacle covered with a transparent cap, a metal coil holder mounted in the receptacle and insulated by insulative means, a coil mounted on the metal coil holder inside the transparent cap, a LED holder block suspended inside the transparent cap above the metal coil holder within the coil, a LED installed in the LED holder block, and two diodes vertically connected between two opposite ends of the LED and the metal coil holder and forming with the metal coil holder and the LED a closed circuit.

3 Claims, 5 Drawing Sheets

LIGHTING CIRCUIT AND ANTENNA ARRANGEMENT OF A CELLULAR TELEPHONE

BACKGROUND OF THE INVENTION

The present invention relates to a cellular telephone, and more specifically to a lighting circuit and antenna arrangement for a cellular telephone which enables the length of the coil of the antenna of the cellular telephone to be minimized without affecting its function.

A variety of cellular telephones have been developed, and have appeared on the market. A cellular telephone has an antenna for receiving and transmitting signal. In order to minimize the dimension of a cellular telephone, the length of the antenna (coil) must be limited. Further, the antenna of a cellular telephone may be mounted with a LED (light emitting diode), which emits light when the cellular telephone is in operation.

FIGS. 1 and 2 show a lighting circuit and antenna arrangement for a cellular telephone according to the prior art. As illustrated, a transparent cap 11 is covered on a receptacle 10. A post 12 is mounted inside the transparent cap 11 and connected to a connector 14 at the center of the receptacle 10. A coil 13 is mounted on the post 12 within the transparent cap 11. A downward extension rod 15 is extended from the connector 14 at the bottom and connected to the power supply circuit of the cellular telephone. A LED (light emitting diode) 16 is mounted on the post 12 at the top inside the transparent cap 11. The LED 16 has two legs, namely, the long leg 161 and the short leg 162 respectively connected to the coil 13. The long leg 161 of the LED 16 is inserted through an axially extended eccentric hole 17 in the post 12 and connected to a diode 163 in the eccentric hole 17, and then bent outwards and extended out of a side slot 18 on the post 12 and connected to a middle part of the coil 13. The short leg 162 of the LED 16 is bent outwards and connected to an upper part of the coil 13 above the post 12. By means of the impedance of the coil 13, the voltage is increased to turn on the LED 16, causing the LED 16 to emit light. Because the legs 161,162 of the LED 16 are respectively welded to the coil 13 at different elevations, the coil 13 must have a certain length L. Therefore, the antenna of the cellular telephone cannot be minimized. Furthermore, because the legs 161,162 of the LED 16 are directly welded to the coil 13 and driven by the impedance of the coil 13 to emit light, the installation of the LED 16 affects the signal receiving/transmitting operation of the coil 13.

SUMMARY OF THE INVENTION

The present invention has been accomplished to provide a lighting circuit and antenna arrangement for a cellular telephone which eliminates the aforesaid drawbacks. According to the present invention, the lighting circuit and antenna arrangement comprises a receptacle covered with a transparent cap, a metal coil holder mounted in the receptacle and insulated by insulative means, a coil mounted on the metal coil holder inside the transparent cap, a LED holder block suspended inside the transparent cap above the metal coil holder within the coil, a LED installed in the LED holder block, and two diodes vertically connected between two opposite ends of the LED and the metal coil holder and forming with the metal coil holder and the LED a closed circuit. Because the lighting circuit is not welded to the coil, the length of the coil can be minimized, and the operation of the LED does not affect the function of the coil.

DETAILED DESCRIPTION OF THE PREFERRED EMBODIMENT

Figure 1:
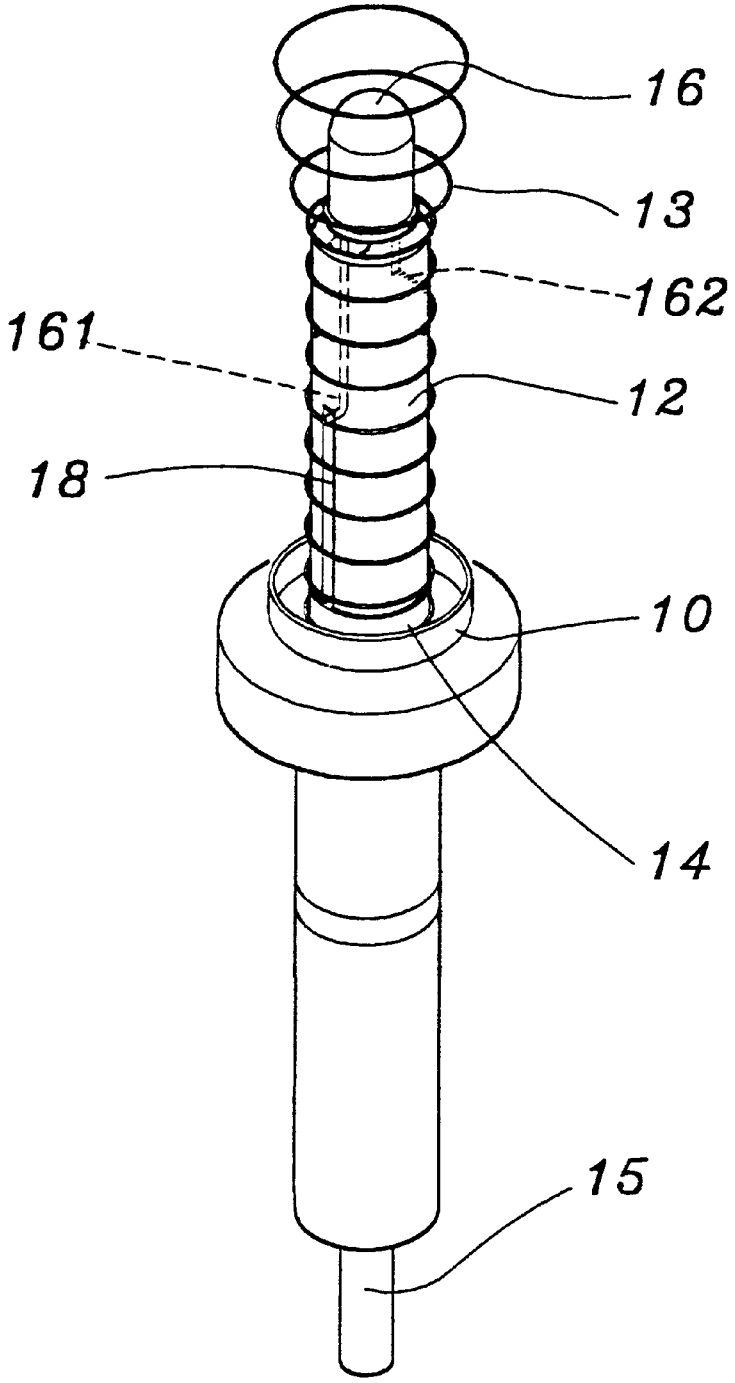
FIG. 1 PRIOR ART
FIG. 1 shows a lighting circuit and antenna arrangement for a cellular telephone according to the prior art.
Figure 2:
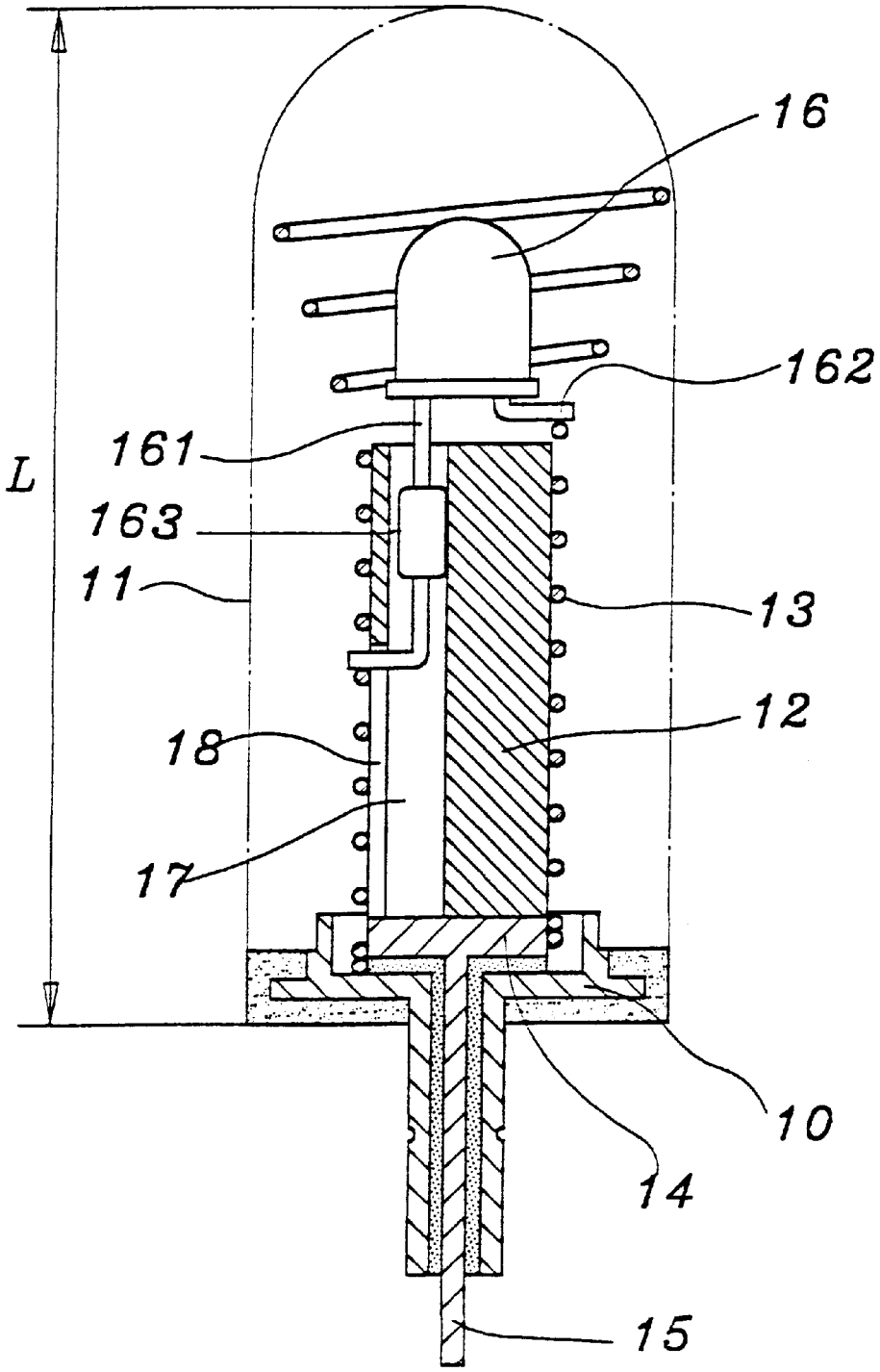
FIG. 2 PRIOR ART
FIG. 2 is a sectional view in an enlarged scale of the arrangement shown in FIG. 1.
Figure 3:
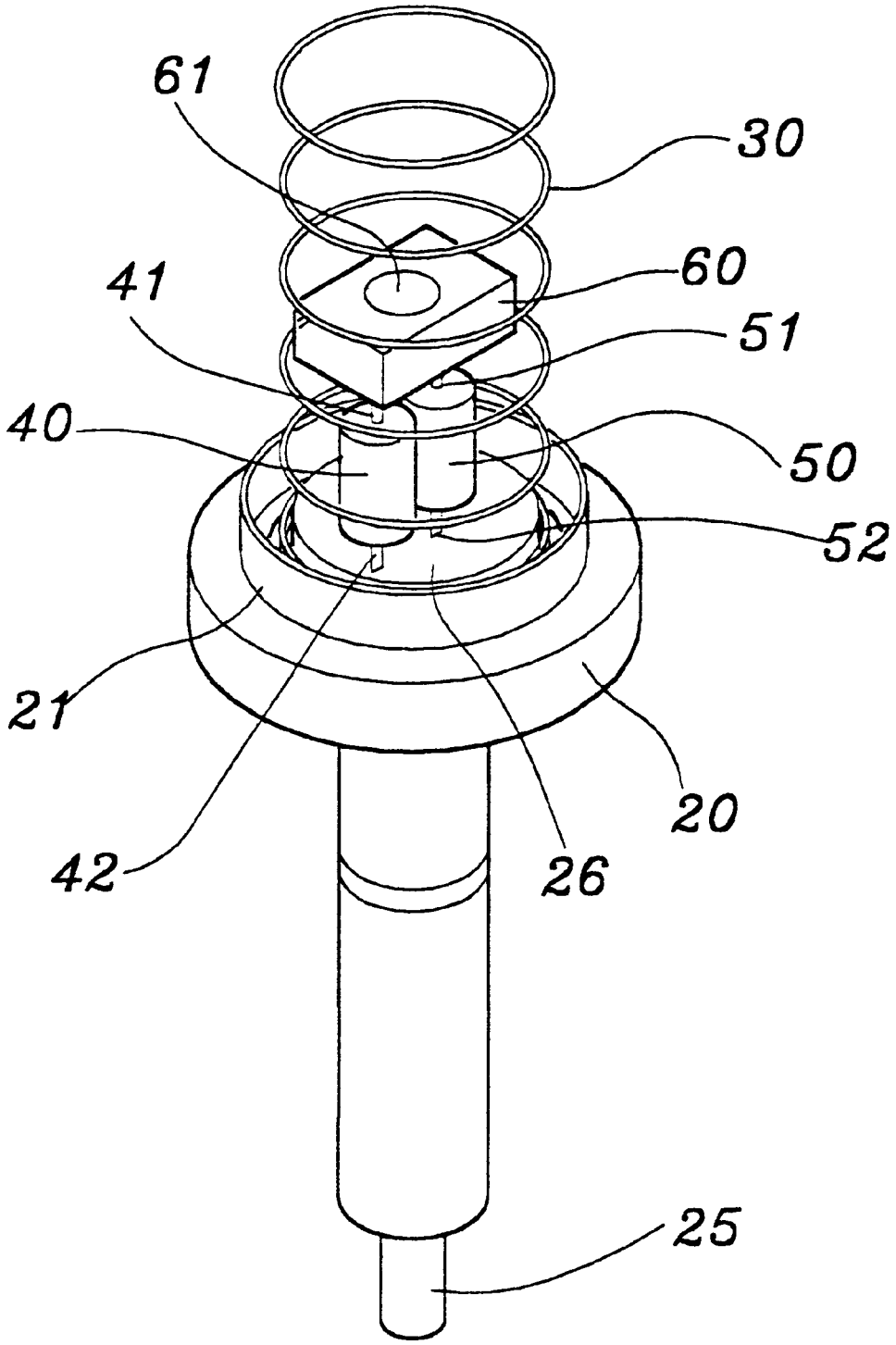
FIG. 3 shows a lighting circuit and antenna arrangement for a cellular telephone according to the present invention.
Figure 4:
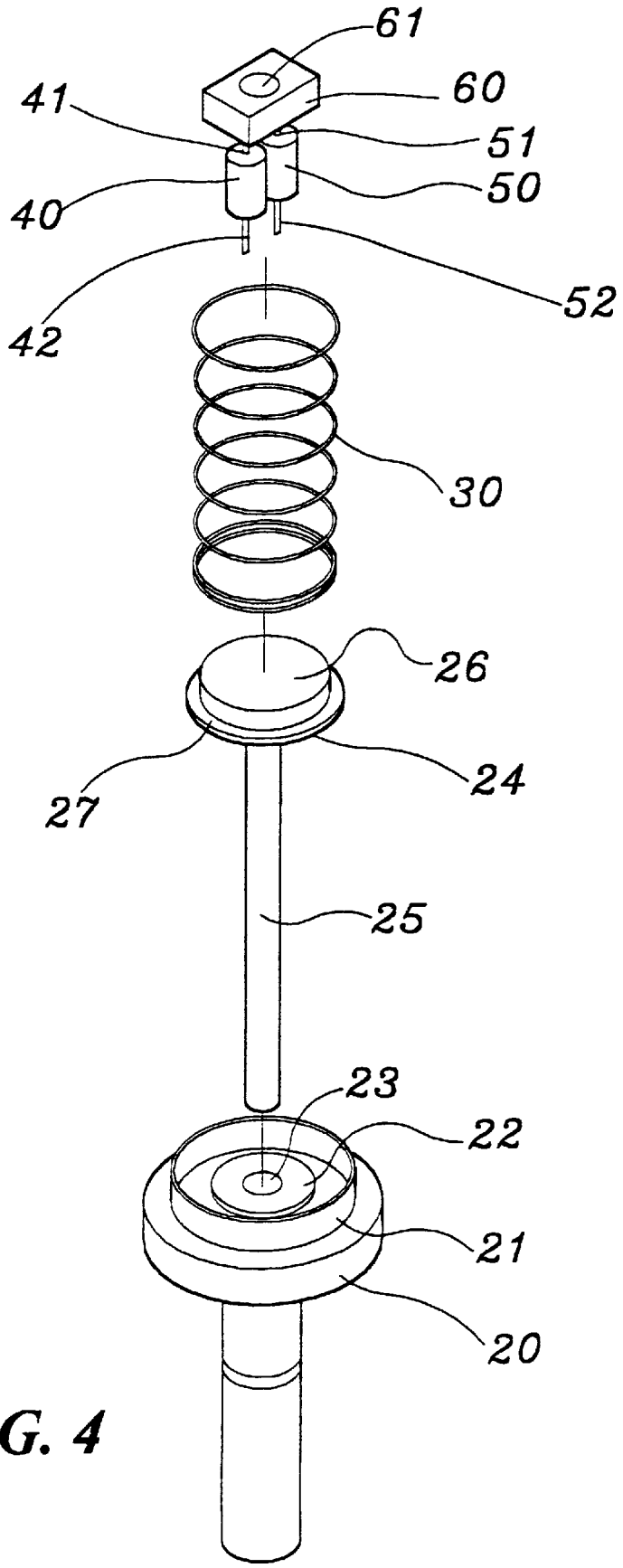
FIG. 4 is an exploded view of the arrangement shown FIG. 3.

Referring to FIGS. 3 and 4, an insulative member 22 is mounted in a receptacle 20 at the center. The insulative member 22 defines an axial center through hole 23. The receptacle 20 comprises an upward annular flange 21 raised from the top side wall thereof around the insulative member 22. A metal coil holder 24 is mounted in the receptacle 20 within the upward annular flange 21. The metal coil holder 24 comprises a downward bottom rod 25 inserted through the axial center through hole 23 and extended out of the bottom side of the receptacle 20 for connection to a power supply circuit, a top block 26 raised from the top side wall thereof. The top block 26 defines with the top side wall of the metal coil holder 24 a step 27. A coil 30 is mounted on the step 27 of the metal coil holder 24 around the top block 26. After installation, the coil 30 may be fixedly fastened to the metal coil holder 24 by tin soldering.

A LED holder block 60 is suspended above the metal coil holder 24 within the coil 30. The LED holder block 60 holds a LED 61 at the center. A first diode 40 is provided having a first leg 41 at one end connected to a first end of the LED 61, and a second leg 42 at an opposite end connected to the top block 26 of the coil holder 24. A second diode 50 is provided having a first leg 51 at one end connected to a second end of the LED 61, and a second leg 52 at an opposite end connected to the top block 26 of the coil holder 24. Therefore, the metal coil holder 24, the first diode 40, the LED 61 and the second diode 50 form an one-way loop.

Figure 5:
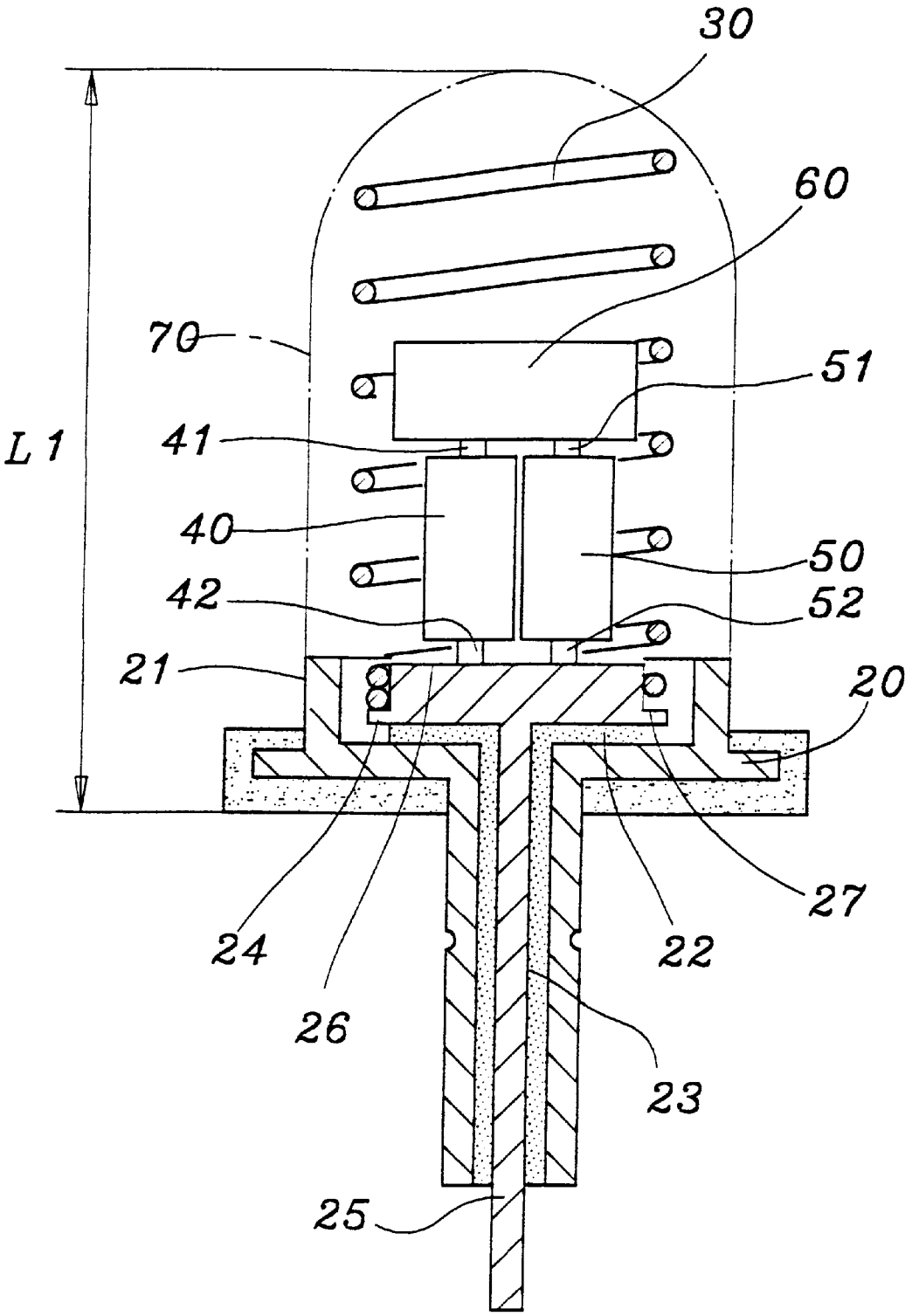
FIG. 5 is a sectional view in an enlarged scale of the arrangement shown in FIG. 3.

Referring to FIG. 5, when power supply is connected, electric current passes from the metal coil holder 24 through the first diode 40 to the LED 60, and then passes from the LED 60 through the second diode 50 to the metal coil holder 24 again, causing the a potential to be produced to turn on the LED 61, causing the LED 61 to emit light through a transparent cap 70, which is covered on the receptacle 20 over the coil 30.

Because the lighting circuit of the LED 61 and the diodes 40,50 is not directly welded to the coil 30, the length L1 of the coil 30 can be minimized, and the operation of the lighting circuit does not affect the function of the coil 30.

While only one embodiment of the present invention has been shown and described, it will be understood that various modifications and changes could be made thereunto without departing from the spirit and scope of the invention disclosed.

What the invention claimed is:

1. A lighting circuit and antenna arrangement comprising a receptacle covered with a transparent cap, a metal coil holder mounted in said receptacle and insulated from said receptacle by insulative means, a coil mounted on said metal coil holder inside said transparent cap, and a lighting circuit installed in said metal coil holder, wherein said lighting circuit comprises a LED holder block suspended inside said transparent cap above said metal coil holder within said coil, a LED installed in said LED holder block, said LED having a first end and a second end, a first diode having a first leg at one end connected to the first end of said LED and a second leg at an opposite end connected to said metal coil holder, a second diode having a first leg at one end connected to the second end of said LED and a second leg at an opposite end connected to said metal coil holder.

2. The lighting circuit and antenna arrangement of claim 1 wherein said metal coil holder comprises a top block raised from a top side wall thereof, said top block being inserted into said coil and welded to the second leg of said first diode and the second leg of said second diode.

3. The lighting circuit and antenna arrangement of claim 2 wherein said coil has a bottom end welded to the top side wall of said metal coil holder around said top block.

* * * * *